US006574974B1

(12) United States Patent
Herzog et al.

(10) Patent No.: US 6,574,974 B1
(45) Date of Patent: Jun. 10, 2003

(54) ICEMAKER ELECTRONIC CONTROL METHODS AND APPARATUS

(75) Inventors: Rollie Richard Herzog, Louisville, KY (US); Michael Edward Johnson, Bardstwon, KY (US); Craig Iung-Pei Tsai, Louisville, KY (US); Qiao Lu, Brea, CA (US); Lisa Gay Smith, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/678,065

(22) Filed: Oct. 2, 2000

(Under 37 CFR 1.47)

(51) Int. Cl.[7] ..... F25C 1/00
(52) U.S. Cl. ..... 62/135; 137/351
(58) Field of Search ..... 62/165, 167, 233, 62/351

(56) References Cited

U.S. PATENT DOCUMENTS

| | | | | | |
|---|---|---|---|---|---|
| 4,429,550 | A | | 2/1984 | Latter | |
| 4,833,894 | A | * | 5/1989 | Chestnut | 62/135 |
| 4,838,026 | A | | 6/1989 | Searl | |
| 4,923,494 | A | * | 5/1990 | Karlovits | 62/73 |
| 5,056,321 | A | * | 10/1991 | Patrick | 62/73 |
| 5,187,948 | A | * | 2/1993 | Frohbieter | 62/351 |
| 5,596,182 | A | * | 1/1997 | Edwards et al. | 200/61.2 |
| 5,768,899 | A | * | 6/1998 | Lee et al. | 62/137 |
| 6,334,318 | B1 | | 1/2002 | Ando et al. | |
| 2001/0025492 | A1 | | 10/2001 | Niwa et al. | |

* cited by examiner

*Primary Examiner*—William C. Doerrler
*Assistant Examiner*—Mohammad M. Ali
(74) *Attorney, Agent, or Firm*—H. Neil Houser, Esq.; Armstrong Teasdale LLP

(57) ABSTRACT

An electronic controller for an automatic icemaker includes a thermistor coupled to an icemaker mold, a first transducer coupled to a rake, a second transducer coupled to a feeler arm, and a processor. Time and temperature dependent calculations are summed at successive time intervals and compared to a predetermined value to determine when ice is frozen and ready for harvesting. Harvesting is delayed a pre-selected time based upon the position of the feeler arm to avoid premature harvesting. A harvest fix algorithm is executed when ice is not harvested within a predetermined time period by operating a heater at an elevated temperature and by de-energizing a motor. A water fill algorithm determines whether the mold is full of water based upon a change in the thermistor reading.

8 Claims, 9 Drawing Sheets

ICEMAKER ELECTRONIC CONTROL METHODS AND APPARATUS

BACKGROUND OF THE INVENTION

This invention relates generally to icemakers, and more particularly to control systems for icemakers in refrigerators.

Known icemakers typically include a number of electromechanical elements that manipulate a mold to shape ice as it freezes. For example, a heater is used to heat the mold to allow release of ice cubes, and a motor rotationally drives a rake to remove ice cubes from the mold and into an ice bucket. See, for example, U.S. Pat. Nos. 4,429,550 and 4,838,026, both of which are assigned to the present assignee. Cam driven switches and a thermostat are typically used to determine when to harvest ice from the mold, and also for opening and closing a water valve to fill the mold with water once a harvest cycle is complete.

Such icemakers, however, are disadvantageous in several aspects. For example, cam driven water valve controls are not as accurate as desired, so that each control must be calibrated for each icemaker that is produced. Also, fluctuating water pressure can render cam driven water valve controls ineffective. Furthermore, known icemakers are vulnerable to jamming during harvest operations.

BRIEF SUMMARY OF THE INVENTION

In an exemplary embodiment of the invention, an electronic controller is provided for an automatic icemaker including a mold, a heater coupled to the mold, a rake for ejecting ice from the mold, and a feeler arm in communication with an ice storage bin. The controller includes a thermistor in fluid communication with the mold to determine a temperature of ice, water, or air in the mold, a first transducer coupled to the rake for sensing a position of the rake, a second transducer coupled to the feeler arm for determining a position of the feeler arm, and a processor coupled to the first transducer, the second transducer, and the thermistor.

In one aspect of the invention, the processor is programmed to execute a freeze state for freezing water in the mold in which a temperature input value is calculated at successive time intervals. The calculated values are cumulatively summed at each successive time cycle, and the summed value is compared to a predetermined harvest count value that ensures adequately frozen ice. When the summed value exceeds the harvest count value, the controller operates the heater and rake to harvest the ice from the mold. The calculations are time and temperature dependent and therefore the controller, unlike known controllers employing fixed temperature and cam-driven controls, efficiently and accurately determines when ice is frozen and ready for harvesting based on temperature conditions of the mold and an integration of time and temperature conditions. Ice production is consequently optimized.

In another aspect of the invention, the controller is programmed to delay a harvest of ice, based upon the position of the feeler arm, for a pre-selected time after the summed value exceeds the harvest count value. Premature harvesting is therefore avoided when a storage bin or ice bucket is removed from the refrigerator or appliance.

In a further aspect of the invention, the controller is programmed to execute a harvest fix algorithm when ice is not harvested within a predetermined time period. Specifically, the controller operates the heater at an elevated temperature when in the harvest fix mode, and de-energizes the motor for a predetermined time period to clear obstructions in the icemaker and avoid associated service calls.

In yet another aspect of the invention, the controller is programmed to determine whether the mold is full of water based upon a reading from the thermistor. Specifically, the controller opens a water valve to fill the mold with water for a predetermined time period, reads a signal from the thermistor; and determines whether the mold is full based upon a change, or lack thereof, in the thermistor reading. If desired, additional filling periods may be executed for pre-selected times to fill the mold to a desired level. Thus, inefficient freezing of a less than full mold is avoided.

Implemented by solid state electronics and logic-driven controls, a more efficient, accurate, and reliable icemaker system is provided.

DETAILED DESCRIPTION OF THE INVENTION

Figure 1:
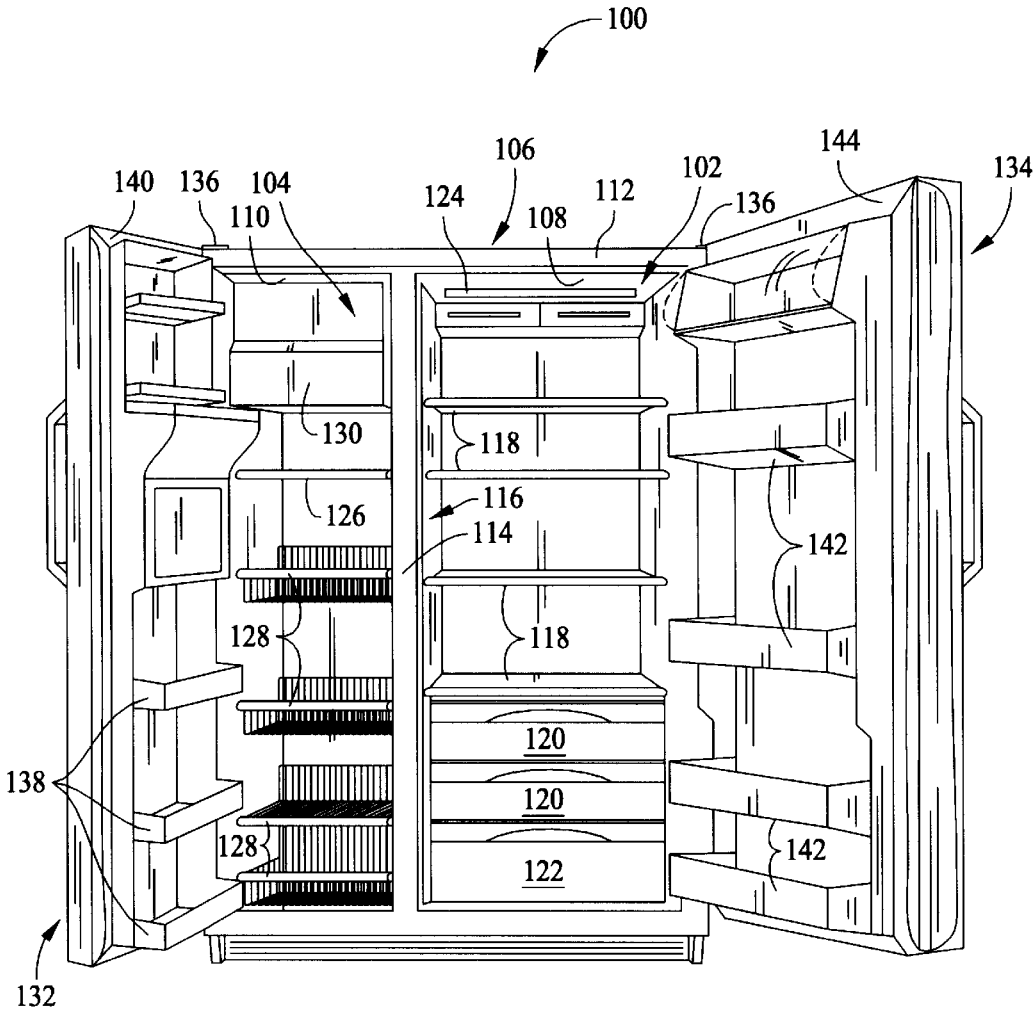
FIG. 1 is a perspective view of a refrigerator including an icemaker.

FIG. 1 illustrates an exemplary refrigerator 100 in which the present invention may be practiced. While the present invention is described in the context of a specific refrigerator 100, it is contemplated that the present invention may be practiced in other types of refrigerators as well as icemaking machines. Therefore, as the benefits of the present invention accrue generally to icemaker controls in a variety of refrigeration appliances and machines, the description herein is for exemplary purposes only and is not intended to limit practice of the invention to a particular refrigeration appliance or machine, such as refrigerator 100.

Refrigerator 100 is a side-by-side refrigerator 100 including a fresh food storage compartment 102 and freezer storage compartment 104. Freezer compartment 104 and fresh food compartment 102 are arranged side-by-side. A side-by-side refrigerator such as refrigerator 100 is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown in FIG. 1) described in detail below and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an icemaker 130 is provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
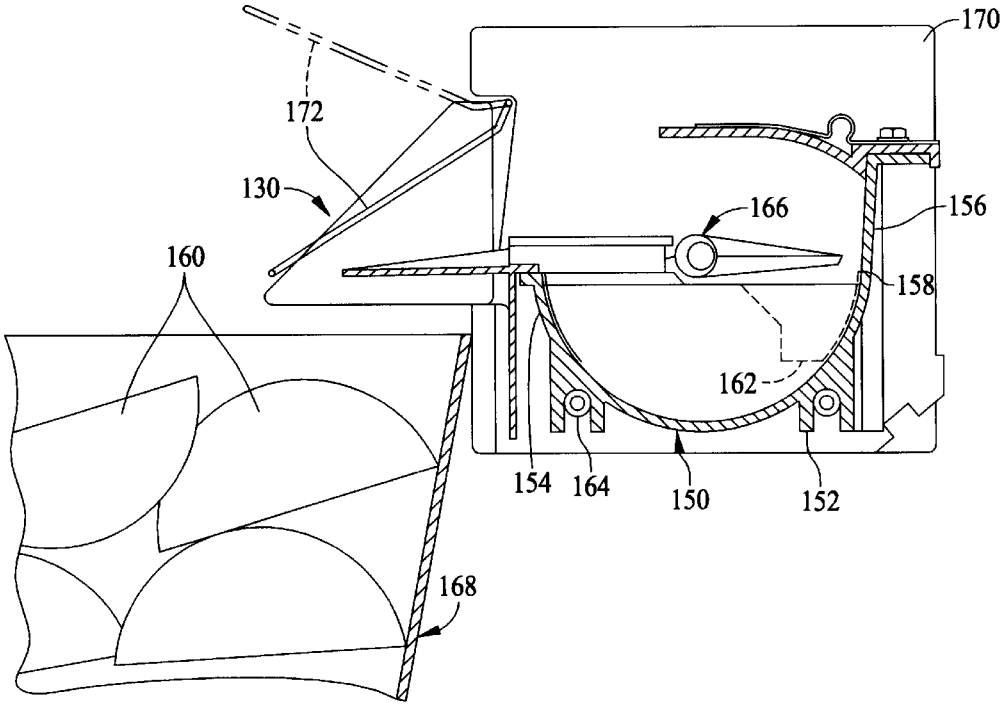
FIG. 2 is a flow chart of a cross sectional view of an exemplary icemaker.

FIG. 2 is a cross sectional view of a known icemaker 130 including a metal mold 150 with a tray structure having a bottom wall 152, a front wall 154, and a back wall 156. A plurality of partition walls 158 extend transversely across mold 150 to define cavities in which ice pieces 160 are formed. Each partition wall 158 includes a recessed upper edge portion 162 through which water flows successively through each cavity to fill mold 150 with water.

A sheathed electrical resistance heating element 164 is press-fit, staked, and/or clamped into bottom wall 152 of mold 150 and heats mold 150 when a harvest cycle is executed to slightly melt ice pieces 160 and release them from the mold cavities. A rotating rake 166 sweeps through mold 150 as ice is harvested and ejects ice from mold 150 into a storage bin 168 or ice bucket. Cyclical operation of heater 164 and rake 166 are effected by a controller 170 disposed on a forward end of mold 150, and controller 170 also automatically provides for refilling mold 150 with water for ice formation after ice is harvested through actuation of a water valve (not shown in FIG. 2) connected to a water source (not shown) and delivering water to mold 150 through an inlet structure (not shown).

In order to sense a level of ice pieces 160 in storage bin, 168 controller actuates a spring loaded feeler arm 172 for controlling an automatic ice harvest so as to maintain a selected level of ice in storage bin 168. Feeler arm 172 is automatically raised and lowered during operation of icemaker 130 as ice is formed. Feeler arm 172 is spring biased to a lowered "home" position that is used to determine initiation of a harvest cycle and raised by a mechanism (not shown) as ice is harvested to clear ice entry into storage bin 138 and to prevent accumulation of ice above feeler arm 172 so that feeler arm 172 does not move ice out of storage bin 168 as feeler arm 172 raises. When ice obstructs feeler arm 172 from reaching its home position, controller 170 discontinues harvesting because storage bin 168 is sufficiently full. As ice is removed from storage bin 168, feeler arm 172 gradually moves to its home position, thereby indicating a need for more ice and causing controller 170 to initiate formation and harvesting of ice pieces 160, as is further explained below.

In another exemplary embodiment, a cam-driven feeler arm (not shown) rotates underneath icemaker 130 and out over storage bin 168 as ice is formed. Feeler arm 172 is spring biased to an outward or "home" position that is used to initiate an ice harvest cycle, and is rotated inward and underneath icemaker by a cam slide mechanism (not shown) as ice is harvested from icemaker mold 150 so that the feeler arm does not obstruct ice from entering storage bin 168 and to prevent accumulation of ice above the feeler arm. After ice is harvested, the feeler arm is rotated outward from underneath icemaker 130, and when ice obstructs the feeler arm and prevents the feeler arm from reaching the home position, controller 170 discontinues harvesting because storage bin 168 is sufficiently full. As ice is removed from storage bin 168, feeler arm 172 gradually moves to its home position, thereby indicating a need for more ice and causing controller 170 to initiate formation and harvesting of ice pieces 160, as is further explained below.

While the following control scheme is described in the context of a specific icemaker 130, the control schemes set forth below are easily adaptable to differently configured icemakers, and the invention is not limited to practice with a specific icemaker, such as, for example, icemaker 130. Moreover, while the following control scheme is described with reference to specific time and temperature control parameters for operating one embodiment of an icemaker, other control parameters, including but not limited to time and temperature values, may be used within the scope of the present invention. The following control scheme is therefore intended for purposes of illustration rather than limitation.

Figure 3:
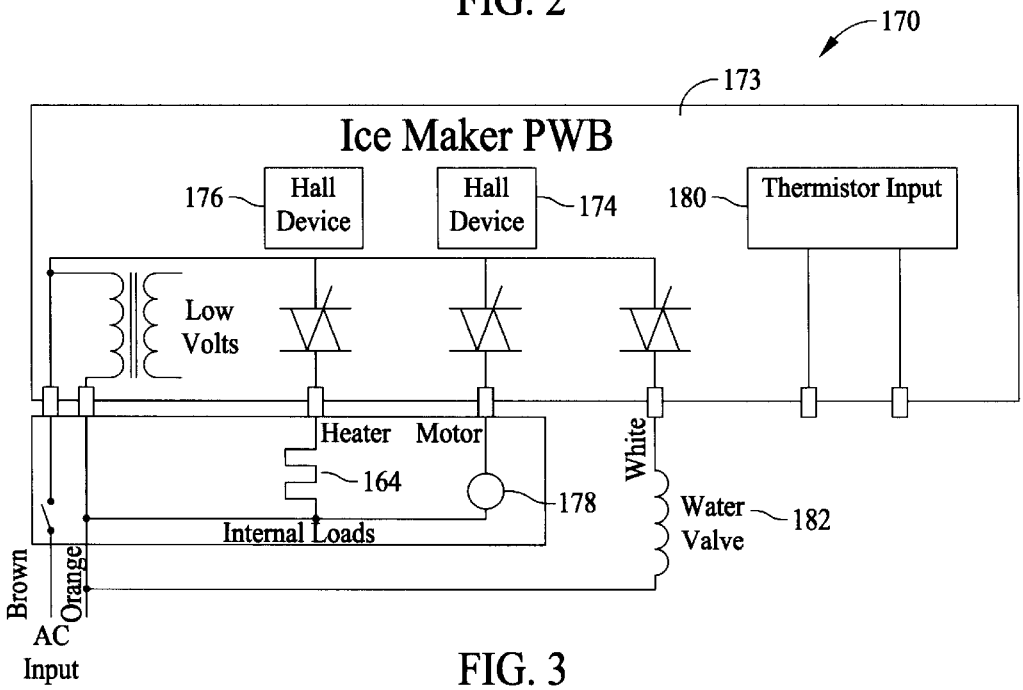
FIG. 3 is a block diagram of an exemplary icemaker controller.

FIG. 3 is a block diagram of an exemplary icemaker controller 170 including a printed wiring board (PWB) or controller board 173 coupled to a first hall effect sensor 174, a second hall effect sensor 176, heater 164, a motor 178 for rotating rake 166 and feeler arm 172 (shown in FIG. 2), at least one thermistor 180 in flow communication with but insulated from icemaker mold 150 (shown in FIG. 2) to determine an operating temperature of ice, water or air therein, and an electromechanical water valve 182 for filling and re-filling icemaker mold 150 after ice is harvested and removed from mold 150. Hall effect sensors 174, 176 and thermistor 180 are known transducers for detecting a position and a temperature, respectively, and producing corresponding electrical signal inputs to controller board 173. First hall effect sensor 174 is used in accordance with known techniques to monitor a position of a motor shaft (not shown) which drives rake 166, and second hall effect sensor 176 is used in accordance with known techniques to monitor a position of feeler arm 172 (shown in FIG. 2). Specifically, hall effect sensors 174, 176 detect a position of magnets (not shown) coupled to rake 166 and feeler arm 172 in relation to a designated "home" position. In response to input signals from first and second hall effect sensors 174, 176 and thermistor 180, controller board 173 employs control logic and a known 8 bit processor to control icemaker components according to the control schemes described below.

In an alternative embodiment, other known transducers are utilized in lieu of hall effect sensors 174, 176 to detect operating positions of the motor shaft and feeler arm 172 for use in feedback control of icemaker 130 (shown in FIGS. 1 and 2). In addition, various types of known processors may be employed with the logic driven control schemes set forth below in controller 170. Still further, in different embodiments, controller 170 provides a stand-alone control for icemaker 130 or is part of an integrated control system (not shown) that interfaces with a main control board (not shown) located elsewhere in refrigerator 100.

Figure 4:
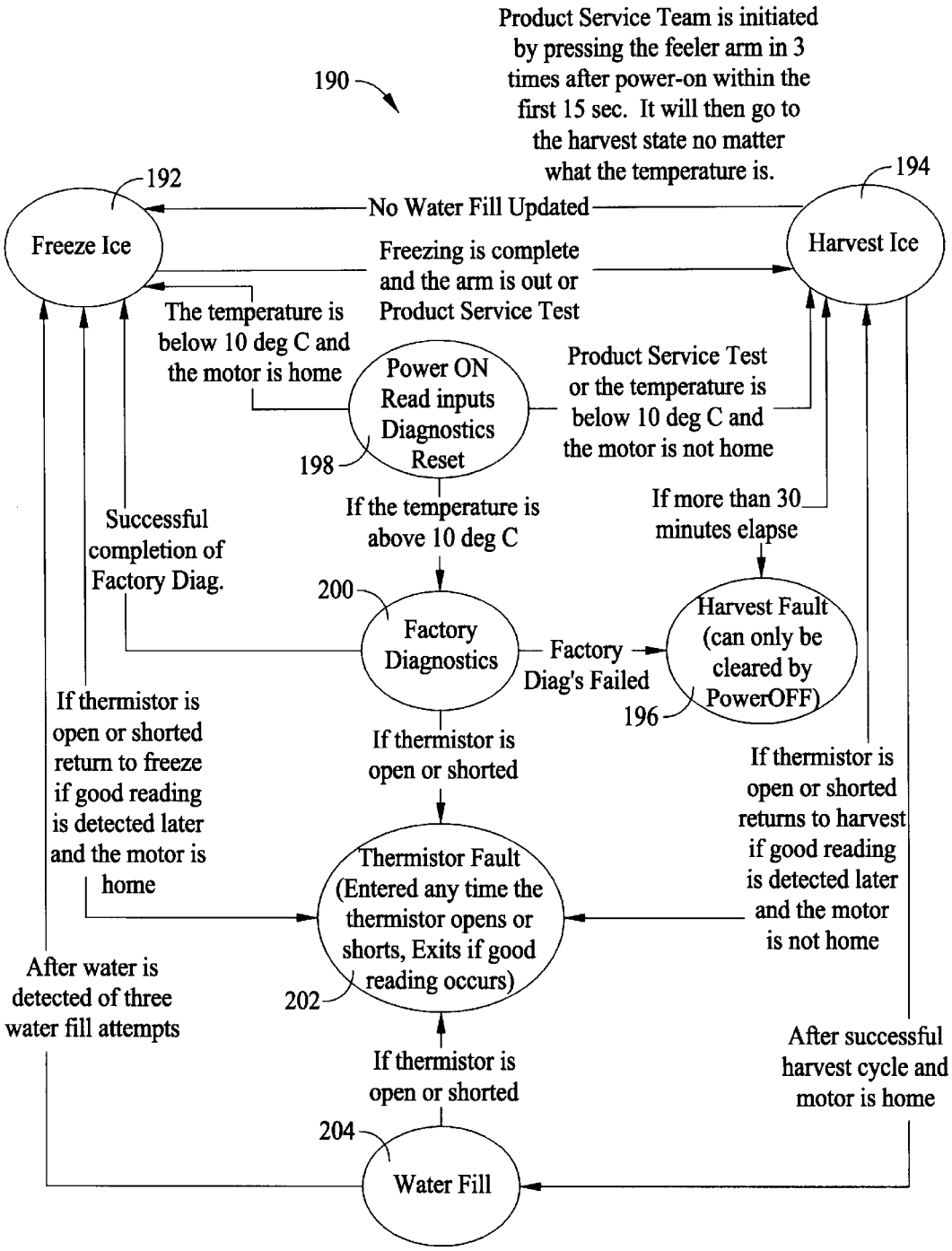
FIG. 4 is a flow chart of an icemaker state diagram executable by the controller shown in FIG. 3.

FIG. 4 is an exemplary icemaker state diagram 190 executable by controller 170 (shown in FIG. 3) and generally including a freeze state 192, a harvest state 194, a harvest fault state 196, power on diagnostics 198, factory diagnostics 200, a thermistor fault state 202, and a water fill state 204. Aspects of the foregoing states are indicated in FIG. 4, and will be in part apparent and in part pointed out hereinafter.

Figure 5:
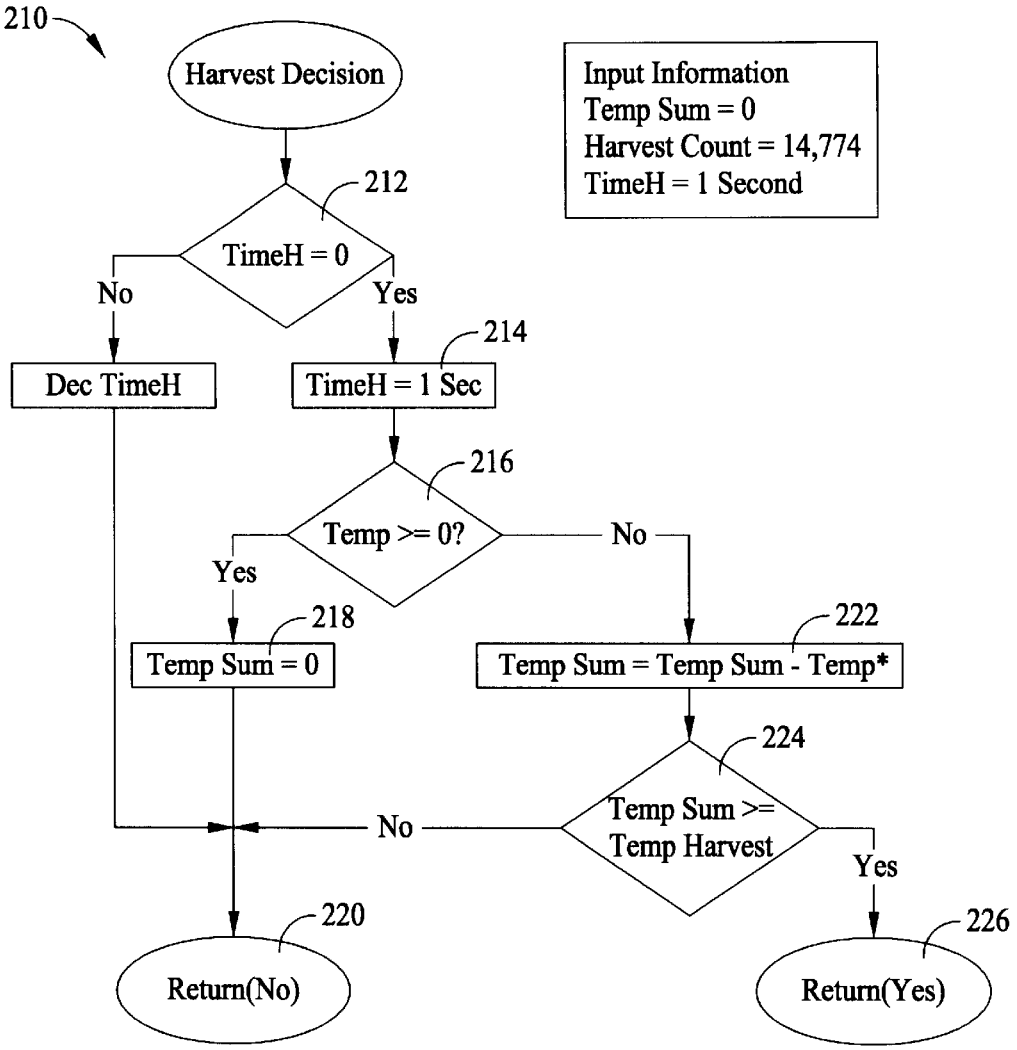
FIG. 5 is a flow chart of a harvest decision algorithm executable by the controller shown in FIG. 3.

FIG. 5 is a flow chart of an exemplary harvest decision algorithm 210 executable by controller 170 (shown in FIG. 3) to determine when ice is frozen in icemaker mold 150 (shown in FIG. 2) and is ready for harvesting. Controller 170 determines 212 whether icemaker 130 is set up for a harvest decision, i.e., whether icemaker mold 150 is filled with water to be frozen. In one embodiment, a flag, such as TimeH is set to zero when icemaker mold 150 is full of water, and controller 170 checks for this indicator to begin algorithm 210. If the flag is not set to zero, a "no" signal is returned to indicate that the harvest decision is not appropriate.

If the indicator is determined 212 to be set to zero, a one second timer is established 214 and for every second, thermistor 180 (shown in FIG. 3) is read to determine 216 whether the temperature in icemaker mold 150 is greater than 0° C., i.e., whether the temperature is above a freezing temperature. If the temperature is above freezing, another indicator, Temp Sum, is set 218 to zero and a "no" signal is returned 220 to indicate that the harvest decision is not appropriate.

If the temperature is determined 214 to be less than 0° C., i.e., below a freezing temperature, then a value Temp Sum is calculated 222 at every nth second according to the following relationship:

$$\text{Temp Sum}_n = \text{Temp Sum}_{(n-1)} - \text{Temp}_n \quad (1).$$

Because Temp Sum is calculated 222 only when the temperature is below freezing, Temp Sum is an increasing positive number with every iteration of the timer cycle. Once Temp Sum is calculated 222 at the nth cycle, controller 170 compares 224 Temp Sum with a predetermined value Temp Harvest that is sufficiently large to ensure that water in icemaker mold has frozen into ice. If Temp Sum is greater than or equal to Temp Harvest, then a "yes" signal is returned 226 to indicate that a harvest is appropriate. If Temp Sum is determined to be less than Temp Harvest, then a "no" signal is returned 220 to indicate that a harvest is inappropriate.

Temp Sum is calculated 222 successively for each timer cycle as long as the temperature in icemaker mold 150 is below freezing. If at any time icemaker mold temperature equals or exceeds 0° C., then Temp Sum is reset 218 to zero. Therefore, using harvest decision algorithm 210, controller 170 is adaptive to changing temperature conditions in icemaker mold 150, thereby increasing icemaking efficiency at low temperatures and avoiding premature activation of a harvest operation at higher temperatures before ice is fully frozen.

In one embodiment, and unlike known systems using fixed time and temperature controls, Temp Harvest is calculated 222 according to the following equation to ensure that ice is frozen solid:

$$\sum_{n=1}^{n=i} x_i^2 = \sum_{n=1}^{n=i} \frac{(t_{n+1} - t_n) * (0 - T_n)}{6{,}412{,}500} \quad (2)$$

wherein x is a thickness (in feet) of ice to be frozen, $t_n$ and $t_{n+1}$ are respective times between summation, and $T_n$ is the below-freezing temperature at each summation.

In one embodiment, $t_{n+1}-t_n$ is held constant and is simply reduced to $\Delta t$ at each summation, and in a further embodiment, $x^2_i$ is about 0.002304 for a particular icemaker mold 150. Therefore, rewriting Equation (2), ice is ready for harvesting when $$\sum_{n=1}^{n=i} \frac{(\Delta t) * ((-T_n)}{6{,}412{,}500} \geq 0.002304. \quad (3)$$

Rearranging Equation (3), it may be seen that ice is ready for harvesting when $$\sum_{n=1}^{n=1} -T_n \geq \frac{14774.4}{\Delta t}. \quad (4)$$

Therefore, using a $\Delta t$ of one second, ice is ready for harvesting when Temp Sum is greater than 14,774. In alternative embodiments, other $\Delta t$ values and/or or $x^2_i$ values are be employed to obtain greater or lesser harvest counts for use in the invention to optimize ice formation in a particular icemaking system.

In a still further embodiment providing greater variability to accommodate various icemaker platforms, controller 170 selects one of several harvest counts for use in making a harvest decision. Therefore, different harvest counts may be employed depending on different sensed conditions or different hardware configurations of controller 170 (shown schematically in FIG. 3). In one such example, two hardware input pins (not shown) are coupled to the controller board processor, and based upon whether the input pins are set "high" or "low" in fabrication of controller board 173 (determined by resistors coupled to the pins), the processor selects a harvest count based upon the condition of the pins. In other words, four different harvest counts are provided, and controller 170 reads the condition of the input pins to select the applicable harvest count for making harvest determinations, such as those shown in the illustrative chart below in which a pin condition of "0" corresponds to "low" and a pin condition of "1" corresponds to "high."

| Pin 1 Condition | Pin 2 Condition | Harvest Count |
|---|---|---|
| 0 | 0 | 9018 |
| 0 | 1 | 5771 |
| 1 | 0 | 6773 |
| 1 | 1 | 11637 |

Figure 6:
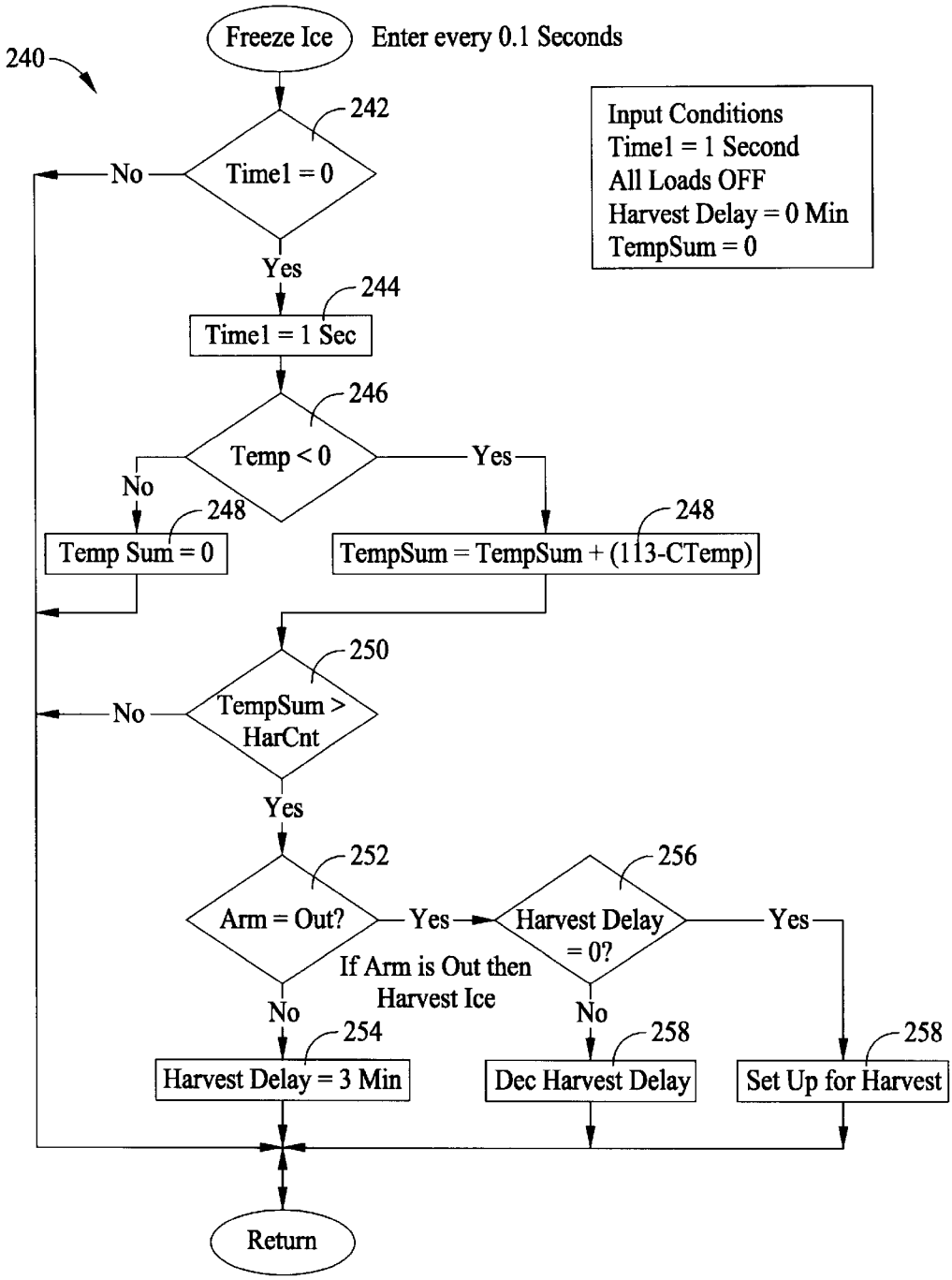
FIG. 6 is a flow chart of a harvest delay algorithm executable by the controller shown in FIG. 3.

FIG. 6 is a flow chart of another exemplary harvest decision algorithm 240 executable by controller 170 (shown in FIG. 3) and including a harvest delay where appropriate to prevent harvesting of ice when an ice bucket, such as storage bin 168 (shown in FIG. 2) is removed from a refrigerator, such as refrigerator 100 (shown in FIG. 1).

Controller 170 determines 242 whether icemaker 130 is set up for a harvest decision, i.e., whether icemaker mold 150 is filled with water to be frozen. In one embodiment, a flag, such as TimeH is set to zero when icemaker mold 150 is full of water, and controller 170 checks for this indicator to begin algorithm 240. If the flag is not set to zero, a "no" signal is returned to indicate that the harvest decision is not appropriate.

If the indicator is set, a one second timer is established 244 and for every second, thermistor 180 (shown in FIG. 3) is read to determine 246 whether the temperature of icemaker mold 150 is greater than 0° C., i.e., whether the temperature is above a freezing temperature. If the temperature is above freezing, another indicator, Temp Sum, is set 248 to zero and a "no" signal is returned to indicate that the harvest decision is not appropriate.

If the temperature is determined 246 to be less than 0° C., i.e., below a freezing temperature, then a value Temp Sum is calculated 248 at every nth second according to the following relationship:

$$\text{Temp Sum}_n = \text{Temp Sum}_{(n-1)} + (113 - \text{CTemp}) \quad (5).$$

Equation (5) is an alternative expression of Equation (1) described above wherein actual temperatures are converted to analog to digital counts and input to controller 170. The digital counts are then summed 248 and compared 250 to a predetermined harvest count. In one embodiment, a temperature of 0° C. corresponds to about 113 digital counts, and for each degree below 0°, CTemp will drop by about 3 digital counts.

Temp Sum is calculated 248 successively for each timer cycle as long as icemaker mold temperature is below freezing. If at any time, icemaker mold temperature equals or exceeds 0° C., then Temp Sum is reset 248 to zero. Therefore, using harvest decision algorithm 240, controller 170 is adaptive to changing temperature conditions in icemaker mold 150, thereby increasing icemaking efficiency and avoiding premature activation of a harvest operation.

Because Temp Sum is calculated 248 only when the temperature is below freezing, Temp Sum is an increasing positive number with every iteration of the timer cycle. Once Temp Sum is calculated 248 at the nth cycle, controller board 173 compares 250 Temp Sum with a predetermined value Temp Harvest that is sufficiently large to ensure that water in icemaker mold has frozen into ice. If Temp Sum is determined to be less than Temp Harvest, then a "no" signal is returned to indicate that a harvest is inappropriate.

If Temp Sum is greater than or equal to Temp Harvest, controller 170 determines 252 a position of feeler arm 172 (shown in FIG. 2) in a manner described above. If feeler arm 172 is away from its "home" position, indicating that the ice bucket 168 is sufficiently full, ice harvest is delayed 254 for three minutes. The delay prevents ice from being harvested when ice storage bin 168 is removed from refrigerator 100. This delay is particularly advantageous for bottom mount icemakers (not shown) including a removable drawer with an integrated ice storage bin. Specifically, when a full ice storage bin or bucket 168 is removed from refrigerator 100, feeler arm 172 returns to the home position and signals a harvest. If ice is ready for harvesting, the harvest delay prevents prompt and undesirable ice harvest just after storage bin 168 is removed, and provides an opportunity for the user to replace storage bin 168 before ice is harvested. In alternative embodiments, a greater or lesser delay than a three minute delay is employed to prevent premature ice harvesting.

If feeler arm 172 is determined 252 to be in its home position, thereby indicating that storage bin 168 is not full of ice, it is determined 256 whether a harvest delay is active, i.e., whether a harvest delay has a nonzero value. If the harvest delay is zeroed out, i.e., inactive, a signal is sent 258 that harvest is appropriate and should be initiated. If the harvest delay is not zeroed out, i.e., harvest delay is active, then the harvest delay continues 258, and algorithm 240 returns and continues.

Figure 7A:
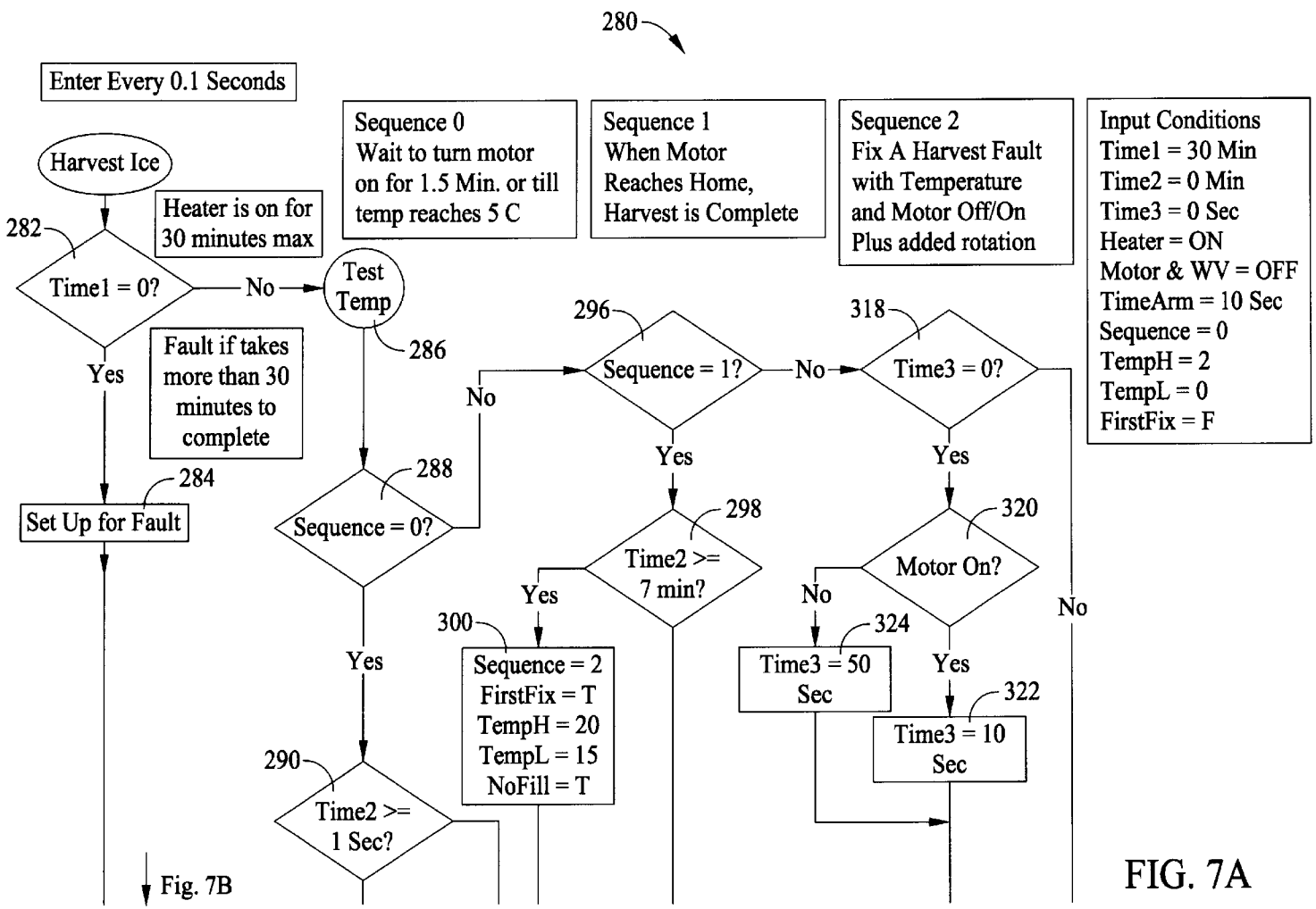
FIG. 7A is a first portion of a flow chart of a harvest fix algorithm executable by the controller shown in FIG. 3.
Figure 7B:
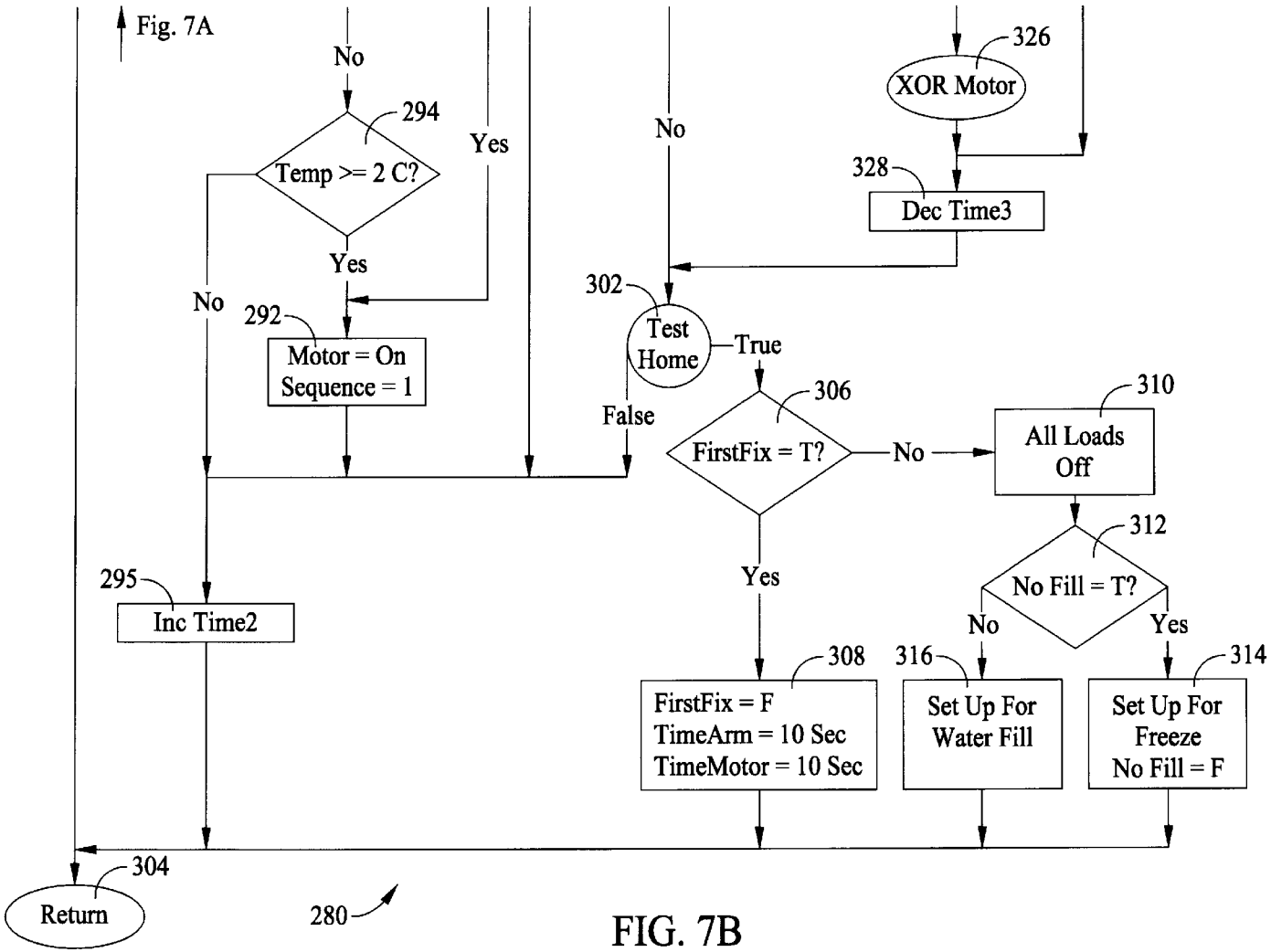
FIG. 7B is a second portion of the flow chart of a harvest fix algorithm executable by the controller shown in FIG. 3.

FIGS. 7A and 7B are a flow chart of a harvest algorithm 280 executable by controller 170 (shown in FIG. 3) and including a harvest fix to minimize service calls due to jamming of icemaker 130. More specifically, three harvest sequences or states are employed, as explained further below, to harvest ice with self-correcting features to minimize service calls due to jamming of icemaker 130.

After a harvest decision is made according to, for example, algorithm 210 (shown in FIG. 5) and/or algorithm 240 (shown in FIG. 6), heater 164 (shown in FIGS. 2 and 3) is turned on to raise the temperature of icemaker mold 150 (shown in FIG. 2) to release ice therein, and a 30 minute timer is established upon energization of heater. Every 0.1 seconds, it is determined 282 whether the 30 minute timer has zeroed out or expired. If the 30 minute timer has expired, flags arc set 284 for a fault condition wherein an indicator is lit or a user is otherwise notified of a fault state of the icemaker.

If the 30 minute timer has not expired, a first test mode is entered 286 in which thermistor 180 (shown in FIG. 3) is read to determine an operating temperature of icemaker mold 150 and operate heater 164 to maintain a mold temperature of, for example, between a lower limit TempL of 0° C. and an upper limit TempH of 2° C.

Controller 170 then determines 288 whether a first harvest sequence, and more specifically a motor delay sequence, is activated by checking whether a sequence flag is set to zero. If the delay is active, i.e., nonzero, controller 170 determines 290 whether a one second delay has expired. If the one second delay has expired, motor 178 is energized, and the motor sequence set 292 to "1," thereby activating the second harvest sequence and disabling the first harvest sequence.

In an alternative embodiment, a delay longer than one second is employed to provide more time for heater 164 to raise icemaker mold temperature before motor is energized.

If the one second timer has not expired, it is determined 294 whether a temperature of icemaker mold 150 (shown in FIG. 2) is greater than or equal to TempH. If the temperature of icemaker mold is found to equal or exceed TempH, motor sequence is activated 292. If the temperature of icemaker mold 150 is found to be less than TempH, then the one second timer is incremented 295 and returned to harvest algorithm 280.

Thus, the first harvest sequence delays energization of motor 178 until a predetermined time has expired or until a predetermined mold temperature is reached, whichever occurs first.

If the motor delay sequence is determined 288 to be nonzero, i.e., the first harvest sequence is disabled, it is determined 296 whether the second harvest sequence is activated by determining whether the Sequence flag is set to "1." If the second harvest sequence is active, motor 178 (shown in FIG. 3) is energized and controller 170 determines 298 whether seven minutes has elapsed since the first test mode was entered 286. If seven minutes has elapsed, a third harvest sequence, and more specifically a harvest fix sequence is activated 300 by setting the Sequence flag to "2," and parameters FirstFix, TempH, TempL, and NoFill are set or reset to T, 20° C., 15° C. and T, respectively. Thus, a harvest fix is activated if motor 178 does not reach its home position in seven minutes or less after first test mode is entered 286. When the harvest fix is activated 300, heater 164 (shown in FIG. 3) is operated at elevated temperatures between 15° C. and 20° C. to melt ice pieces that may have jammed icemaker 130.

If elapsed time is less than seven minutes since heater 164 was energized, a second test mode 302 is entered in which it is checked whether feeler arm 172 (shown in FIG. 2) and motor 178 are in their respective "home" positions and also whether motor 178 and the feeler arm mechanism are energized or activated in an attempt to return rake 166 (shown in FIG. 2) and feeler arm 172 (shown in FIG. 2) to their "home" positions. If either rake 166 or feeler arm 1 72 is not "home," motor 178 and the feeler arm mechanism are de-energized or deactivated for a selected time, such as ten seconds, to release pressure and binding forces in the system that may be contributing to a jam.

If feeler arm 172 and rake 66 are neither "home" nor deactivated for the selected time period, second test mode returns "false," and algorithm 280 returns 304 and continues.

If both rake 166 and feeler arm 172 are "home" and deactivated for the selected time, second test mode returns "true" and it is determined 306 whether a harvest fix is active, i.e., whether FirstFix was set to T in step 300. If so, FirstFix is reset 308 to F to deactivate a harvest fix and the deactivation timers for motor 178 and feeler arm 172 are reset 308 to the predetermined time, e.g., ten seconds. The reset values are returned 304 and algorithm 280 continues.

If it is determined 306 that a harvest fix is not active, all loads are turned off 310 and it is determined 312 whether NoFill was set to T in step 300. If NoFill was set to T in a harvest fix, NoFill is reset 314 to F and the system is reset to re-freeze remnants of ice melted in the harvest fix and avoid re-filling of icemaker mold 150 that would result in an overflow condition. If it is determined 312 that NoFill was not set to T in step 300, then icemaker mold 150 is set 316 for a re-fill of water and algorithm 280 returns to the main routine.

If the first harvest sequence is determined 288 to be disabled via a nonzero Sequence flag, and further when the second motor sequence is determined 296 to be also disabled, i.e., when the Sequence flag is not set to "1" and the harvest fix is active via the Sequence flag set to "2", it is determined 318 whether Time3 is set to zero. If Time3 is set to zero, it is further determined 320 whether motor 178 is energized. If motor 178 is determined 320 to be energized, Time3 is reset 322 to 10 seconds and the motor is turned off. If motor 178 is determined 320 to not be energized, Time3 is reset 324 to 50 seconds and the motor is turned on. After Time3 is reset 322 or 324, motor 178 is switched 326 from its present state at the expiration of the applicable reset period. In other words, motor 178 is cycled on for 10 seconds and cycled off for 50 seconds during the harvest fix to facilitate clearing of a jam.

When Time3 does not equal zero, and after Time3 has been reset 322 or 324 and motor switched 326 as stated, Time3 is decremented 328 and algorithm 280 continues.

Therefore, harvest operation and corrective measures are implemented in control logic according to algorithm 280 to harvest ice at appropriate times with self-correction to clear ice obstructions and reduce associated service calls. While one embodiment has been described with specific time periods and control parameter values, in alternative embodiments other values are used within the scope of the present invention.

Figure 8A:
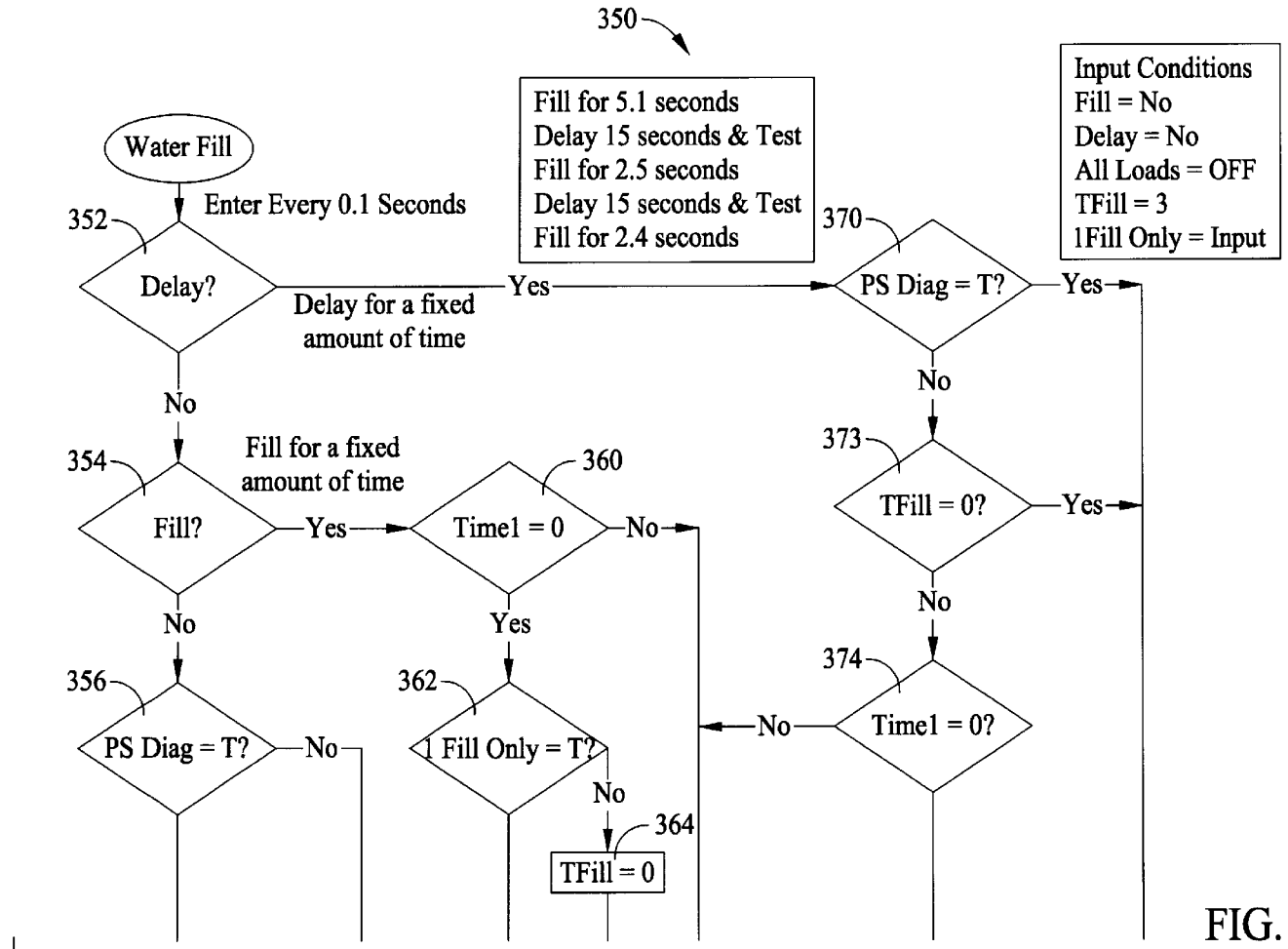
FIG. 8A is a first portion of a flow chart of a water fill algorithm executable by the controller shown in FIG. 3.
Figures 8A, 8B:
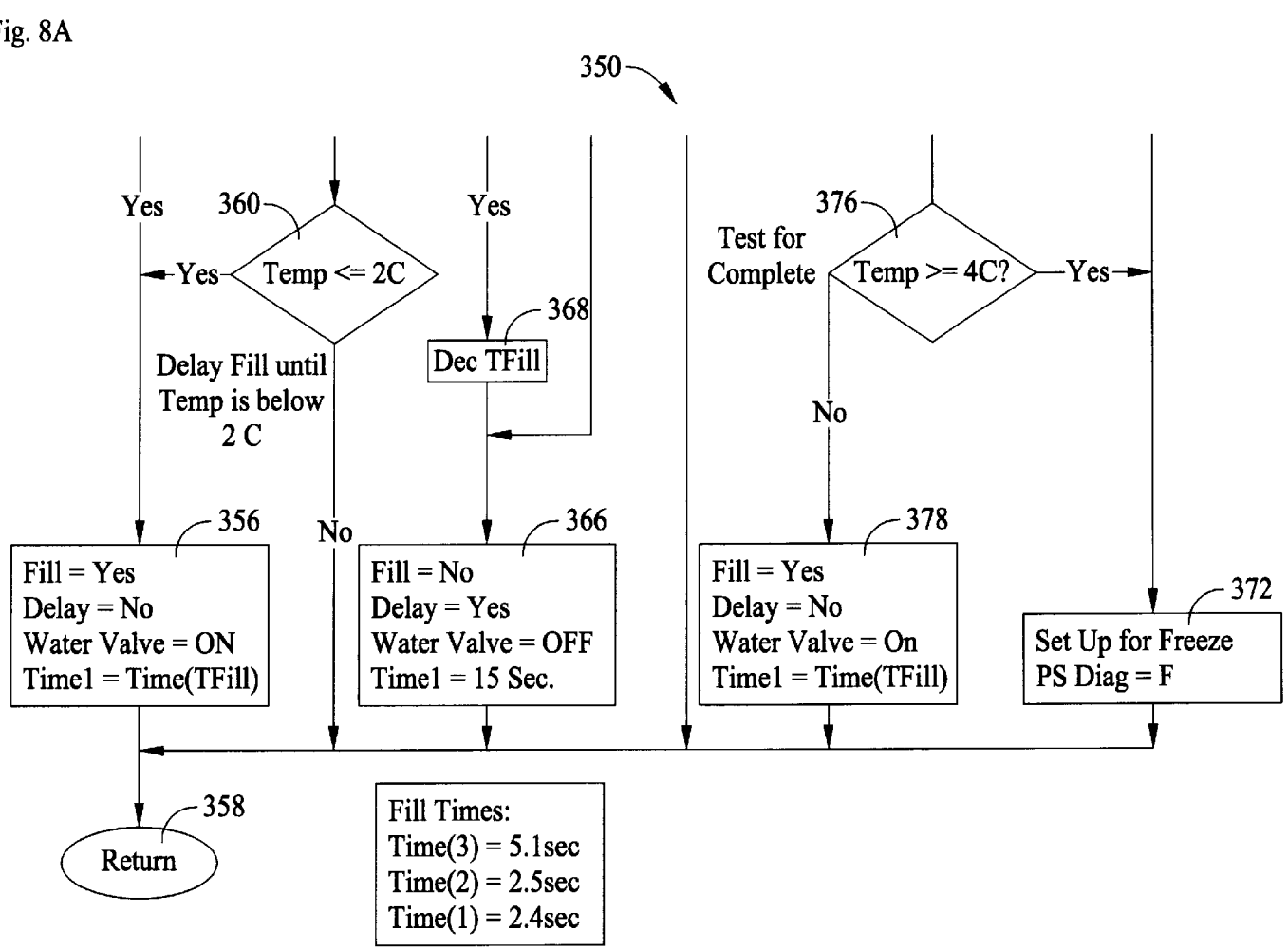
FIG. 8B is a second portion of the flow chart of a water fill algorithm executable by the controller shown in FIG. 3.

FIGS. 8A and 8B are an exemplary water fill algorithm 350 executable by controller 170 (shown in FIG. 3). After a harvest is accomplished according to, for example, algorithm 280 (shown in FIGS. 7A and 7B), algorithm 350 efficiently fills icemaker mold 150 (shown in FIG. 2) for a freezing cycle. Initially, the following control parameters are set. Fill is set to "no," Delay is set to "no", all loads are turned off, and TFill is set to three. Every 0.1 seconds, water fill algorithm begins by checking 352 whether a delay is selected. If Delay is set to "no," then it is determined 354 whether Fill is set to "yes" or "no." If Fill is set to "no," it is determined 355 whether a product service diagnostic test has been executed, or more specifically whether PS Diag=T. In one embodiment, the product service diagnostic test is a test harvest state followed by a water fill and is accessible only in the first 15 seconds of icemaker operation.

If PS Diag=T, then control parameters Fill, Delay, WaterValve, and Time1 are set 356 to "yes,", "no," "on" and Time(3) respectively, wherein Time(3) is set to 5.1 seconds. These parameters are returned 358 and algorithm continues.

In one embodiment, if the product service diagnostic test has not been executed, i.e., PS Diag≠T, then thermistor 180 is read and it is determined 360 whether the ice maker temperature is at or below 2° C. If temperature is at or below 2° C., parameters are reset as described in step 356. If temperature is greater than 2° C., parameters are not reset, thereby creating an effectively delay of water fill until the temperature is at or below 2° C.

If Delay is determined 352 as set to "no" and Fill is determined as set 354 set to "yes," controller 170 determines 360 whether Time1 has expired to zero, which after step 356 is 5.1 seconds. If Time1 has not expired, control parameters are not reset and icemaker mold continues to fill with water.

On the other hand, if Time1 has expired, it is determined 362 whether only one fill is desired. If yes, TFIll is reset 364 to zero and control parameters Fill, Delay, WaterValve, and Time1 are set 366 to "no,", "yes," "off " and 15 seconds respectively, These parameters are returned 358 and algorithm 350 continues.

If more than one fill is allowed, TFill is decremented 368 to Time(2) or 2.5 seconds. Control parameters are then reset as described above in step 366, the parameters are returned and algorithm 350 continues.

When Delay is set to "yes" it is determined 370 whether the product service diagnostic test described above has been executed, or whether PS Diag=T. If the product service diagnostic test has been executed, PS Diag is set 372 to F and icemaker 130 is ready for freeze state 192 (shown in FIG. 4).

When Delay is set to "yes" and the product service diagnostic test has not been executed, controller 170 determines 373 whether TFill is set to zero. If TFill is set to zero, PS Diag is set 372 to F, icemaker 130 is ready for freeze state 192 (shown in FIG. 4), and water fill algorithm 350 is complete. On the other hand, when Delay is set to "yes," the product service diagnostic test has not been executed, and TFill is not set to zero, it is determined 374 whether the fifteen second delay has expired so that water has settled in the mold. If the fifteen second delay has not expired, the control parameters are not reset, and algorithm 350 repeats with the present control parameters.

If, however, the fifteen second delay has expired, thermistor 180 (shown in FIG. 3) is read to determine 376 whether the temperature is at or above 4° C. Since water fill is originally delayed until temperature is determined 362 to be at or above 2° C. via step 360, a temperature change of at least 2° C. to raise the thermistor output to at least 4° C. indicates that water has touched thermistor 180 strategically located in icemaker mold 150, thereby indicating that icemaker mold 150 is full of water. Therefore, if the determined temperature is at or above 4° C., then PS Diag is set 372 to F, icemaker 130 is ready for freeze state 194 (shown in FIG. 4), and water fill algorithm 350 is complete.

If the determined temperature is less than 4° C., control parameters Fill, Delay, WaterValve, and Time1 are set 378 to "yes,", "no," "on" and Time(2), respectively, These parameters are returned 358 and algorithm 350 continues for a second fill time of 2.5 seconds via step 368 where TFill(3) was decremented to TFill(2) at the first pass.

It may be seen that because TFill is originally set to three, that one additional fill time may occur if the determined temperature is again determined 376 to be less than 4° C. because TFill is decremented to Time(1) at step 368 after the second fill completes at step 360. Thus, since Time (1) is set to 2.4 seconds, a third fill of 2.4 seconds is executed when the second fill fails to raise the thermistor by 2° C. at step 376. When all three fills are executed, a total fill time of ten seconds is achieved.

It is contemplated that other control parameter inputs and settings could be used in lieu of those described above to achieve the benefits of the present invention, including but not limited to greater or fewer than three fill periods, and fill periods of greater or lesser time duration to achieve acceptable water fills for various icemakers and various water flow rates.

Thus, using water fill algorithm 350, multiple attempts to fill icemaker mold 150 can me made to produce consistent ice production despite fluctuating water flow rates, thereby avoiding inefficient ice production when icemaker mold 150 is filled at less than capacity with water. As desired, the multiple attempt fill feature can be switched off to only allow a single fill.

Using harvest decision algorithms 210, 240, harvest algorithm 280, and water fill algorithm 350 with logic-driven electronic controls, a more efficient, accurate, and reliable icemaker system is provided.

While the invention has been described in terms of various specific embodiments, those skilled in the art will recognize that the invention can be practiced with modification within the spirit and scope of the claims.

What is claimed is:

1. A controller for an automatic icemaker including a mold, a heater coupled to the mold, a rake for ejecting ice from the mold and a feeler arm in communication with an ice storage bin, said controller comprising:

a thermistor in fluid communication with the mold, a first transducer coupled to the rake for sensing a position thereof;

a second transducer coupled to the feeler arm for determining a position thereof;

a processor coupled to said first transducer, said second transducer, and said thermistor, said processor programmed to:

execute a freeze state for freezing water in the mold;

calculate a temperature input value between successive time intervals;

cumulatively sum the temperature input values at each successive time cycle; and compare the cumulatively summed value to a predetermined harvest count value corresponding to adequately frozen ice.

2. A controller in accordance with claim 1 further programmed to operate the heater and rake to harvest the ice when the summed value exceeds the harvest count value.

3. A controller in accordance with claim 2 further programmed to delay a harvest of ice for a pre-selected time after the summed value exceeds the harvest count value based upon a position of the feeler arm.

4. A controller in accordance with claim 2 further programmed to execute a harvest fix algorithm when ice is not harvested within a predetermined time period.

5. A controller in accordance with claim 4 further programmed to operate the heater at an elevated temperature when in the harvest fix mode.

6. A controller in accordance with claim 5, further programmed to de-energize the motor for a predetermined time period when in the harvest fix mode.

7. A controller in accordance with claim 1 further programmed to determine whether the mold is full of water based upon a reading from said thermistor.

8. A controller for an automatic icemaker including a mold, a heater coupled to said mold, a rake for ejecting ice from the mold and a feeler arm in communication with an ice storage bin, said controller configured to execute at least one of a harvest operation when a summed calculated value exceeds a harvest count value, a harvest delay algorithm when the feeler arm indicates a need for an ice harvest and ice is ready for harvesting, and a harvest fix algorithm when a harvest operation is not completed in a predetermined time period.

* * * * *